United States Patent [19]

Horiuchi

[11] Patent Number: 4,603,850

[45] Date of Patent: Aug. 5, 1986

[54] CONTROLLING METHOD FOR A SORTER

[75] Inventor: Tatumi Horiuchi, Hachioji, Japan

[73] Assignee: Konishiroku Photo Industry Co., Ltd., Tokyo, Japan

[21] Appl. No.: 435,615

[22] Filed: Oct. 20, 1982

[30] Foreign Application Priority Data

Oct. 28, 1981 [JP] Japan ..... 56-173353

[51] Int. Cl.[4] ..... B65H 39/10

[52] U.S. Cl. ..... 271/288; 271/294; 271/298

[58] Field of Search ..... 271/292, 293, 294, 296, 271/288, 298

[56] References Cited

U.S. PATENT DOCUMENTS

| | | | |
|---|---|---|---|
| 4,332,377 | 6/1982 | DuBois | 271/294 X |
| 4,353,542 | 10/1982 | Knight | 271/294 |
| 4,433,837 | 2/1984 | Romanowski | 271/294 X |
| 4,449,812 | 5/1984 | Furuichi | 271/294 X |

*Primary Examiner*—Richard A. Schacher

*Attorney, Agent, or Firm*—Jordan B. Bierman

[57] ABSTRACT

For a sorter with movable bins capable of sorting in both directions from the upper bin to the lower bin and from the lower bin to the upper bin corresponding to a selected number of copies for successive originals, an improved controlling method for the sorter provides for returning the bins to a selected position when the number of copies is changed from the one previously set.

4 Claims, 8 Drawing Figures

CONTROLLING METHOD FOR A SORTER

BACKGROUND OF THE INVENTION

1. Field of the Invention

The present invention relates to a sorter with movable bins and particularly to a controlling method for the sorter with movable bins capable of sorting in both directions from the upper step to the lower step and from the lower step to the upper step.

2. Description of the Prior Art

In the past, a sorter of one-way sorting system such as sorting from the upper step to the lower step or sorting from the lower step to the upper step has widely been employed. This will be explained referring to the drawings. FIG. 1 illustrates a sorter 2 with 5 movable bins connected to the paper exit 11 of the copying machine 1. FIG. 1(*a*) shows a situation where the lowest bin $S_1$ out of 5 bins is connected to the paper exit 11 and is capable of receiving copy papers. Now, if the copying is made with the number of copies set which is 3 on the copying machine one sheet of copy is delivered from the paper exit 11 of the copying machine 1 and is inserted into the bin $S_1$, then bins are moved downward by one step, thus the second copy is inserted into the bin $S_2$ and further downward movement of bins by one step enables the 3rd copy to be inserted into the bin $S_3$ and it stops. FIG. 1(*b*) shows this situation.

If further copying is made for the second original without changing the number of copies set, bins of the sorter 2 move upward by two steps on the one-way sorting system and the first copy is inserted into the $S_1$, the second copy into the bin $S_2$ and the 3rd copy into the bin $S_3$ again.

On the sorter with one-way sorting system, after the copy paper is inserted into the bins $S_3$, next copy is to be inserted into the bin $S_1$, therefore excessive time for returning travel is required for the movement of bins and thereby the copying operation is interrupted. If the moving speed of bins is raised for the shorter interruption time, there have been drawbacks that the driving motor should be large, power consumption is increased and noises are generated.

A sorter of both directions sorting system is one wherein aforesaid drawbacks have been improved. Following is an explanation on the previous example. FIG. 1(*b*) shows a situation wherein three copies are completed when the copying is made for the first original with the number of copies set which is 3. Next, if the further copying is made for the second original without changing the number of copies set, bins of the sorter 2 do not move and the first copy is inserted into the bin $S_3$, the second copy into the bins $S_2$ with a movement of bins upward by one step and the 3rd copy into the bin $S_1$ with further movement of bins upward by one step, on the sorter of both directions sorting system. FIG. 1(*c*) shows this situation. In the both directions sorting system, the time for returning to the original position is not needed in this way, the copy operation will not be interrupted.

Therefore, the sorter with movable bins that can comply with the high speed copying with a relatively low speed of bin movement can be realized with a both directions sorting system. It also has merits that low noise, low power consumption and low cost can be realized because the moving speed of bins is low.

However, there have been drawbacks even on the both directions sorting system. For example, if the copying is made with the number of copies set which is 4 under the condition of FIG. 1(*b*), the first copy is inserted into the bins $S_3$, the second copy into the bin $S_2$ with a movement of bins upward by one step and the 3rd copy into the bin $S_1$ with a further movement of bins upward by one step. Since the 3rd copy corresponds to the bottom step of the bin, the 4th copy is inserted into the bin $S_2$ with a downward movement of bins by one step. Thus, two same copies are inserted into the bin $S_2$ as shown in FIG. 1(*d*), which causes erroneous operation for paper collation.

SUMMARY OF THE INVENTION

The present invention has been devised with an object to prevent aforesaid erroneous operation and said object is attained by the controlling method of the sorter characterized in that a bin position can be returned to the specific standard position when the number of copies set is changed during the operation, in the sorter with movable bins capable of sorting in both directions from the upper step to the lower step and from the lower step to the upper step.

DETAILED DESCRIPTION OF THE PREFERRED EMBODIMENT

Figure 1:
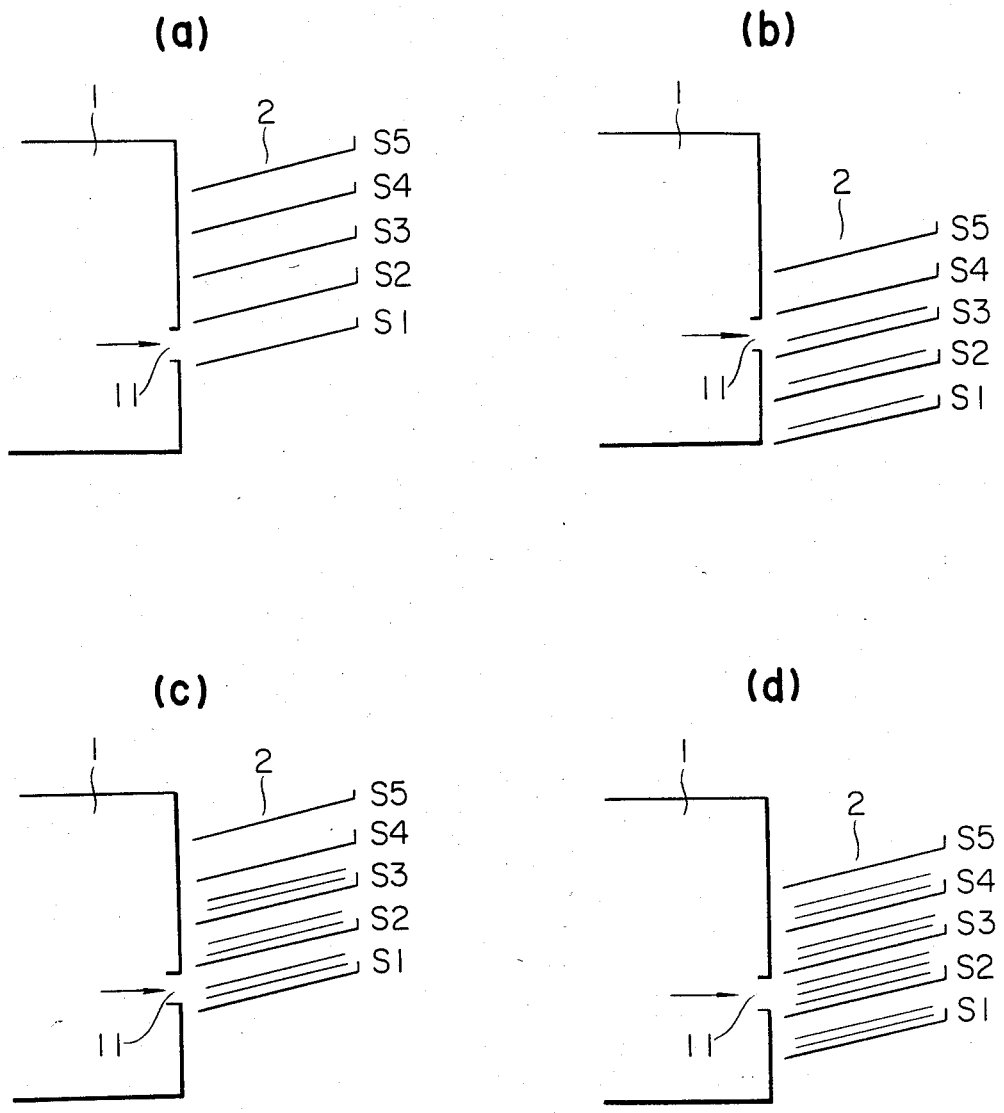
FIG. 1 is a schematic view showing the positional relation between the copying machine and the bins of the sorter.

The present invention will be explained in detail as follows referring to the drawings.

Figure 2:
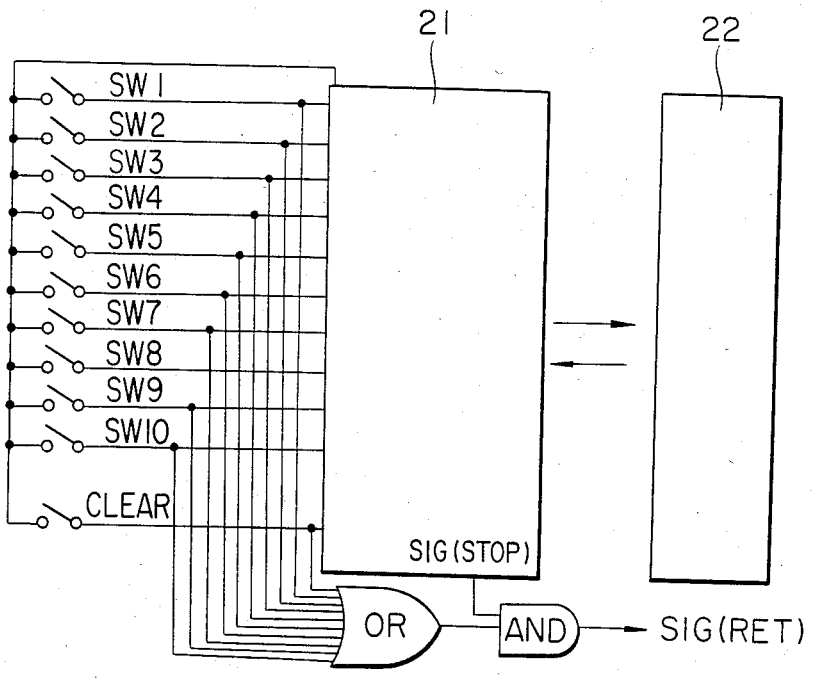
FIG. 2 is a circuit diagram according to the present invention.

FIG. 2 shows an example of the circuit of the present invention and 21 is a reading device for the number of copies set and 22 is a controlling device for the copying machine. Switches $SW_1$–$SW_{10}$ are the switch for setting the number of copies on the copying machine and they are provided on the copying machine together with a clear switch CLEAR that erases the number of copies set for the correction or the like.

When either one of switches $SW_1$–$SW_{10}$ or the clear switch is depressed for the purpose of changing the number of copies set on the copying machine, such information and the stop signal SIG (STOP) from the controlling device 22 for the copying machine which confirms that the copying machine is suspended enter an AND circuit and are outputted on the sorter as a returning signal SIG (RET) for bins, thus the bin position is returned to the specific standard position. Generally, the position where the top or bottom bin of the sorter is connected to the paper exit of the copying machine is a specific standard position.

Figure 4:
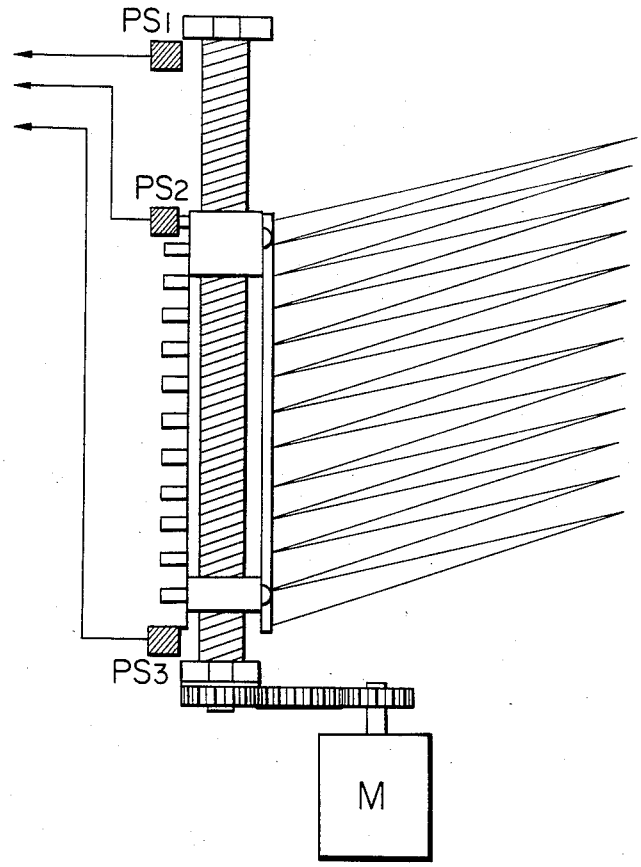
FIG. 4 is a schematic view showing a construction to drive the bins of the sorter.
Figure 5:
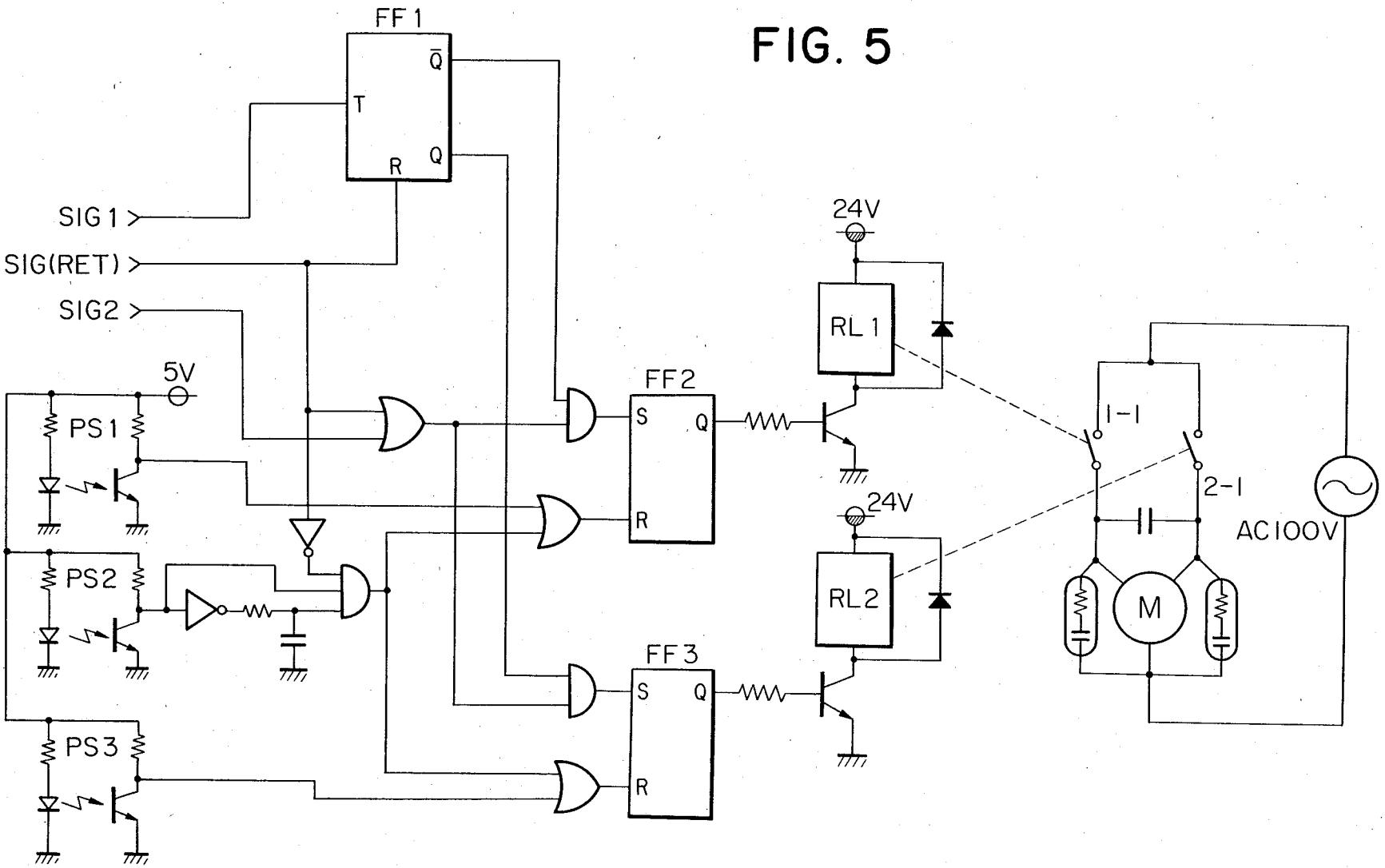
FIG. 5 is a circuit diagram to control the driving of the sorter.

FIG. 4 is a schematic view showing a construction to drive the bins of the sorter. M is a motor to drive the sorter. FIG. 5 is a circuit diagram to control the driving of the sorter. FF1 is a T flip-flop, FF2 is R-S flip-flop and FF3 is R-S flip-flop. SIG1 is a signal representing an end of copy cycle. SIG2 is a signal to move the bins one step. PS1, PS2 and PS3 are position sensor to detect the position of the bins of the sorter.

Figure 3:
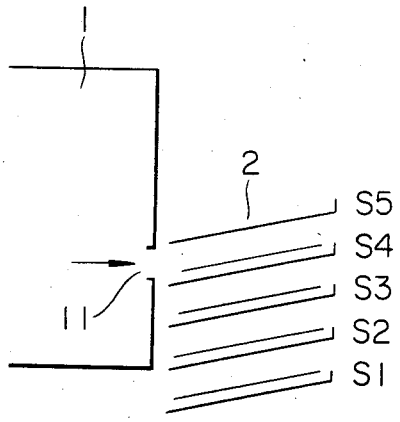
FIG. 3 is a schematic view showing another positional relation between the copying machine and the bins of the sorter.

In the explanation with aforesaid example, if the copying is made with the number of copies set, that is, 3, the copying will be completed with a condition of FIG. 1(*b*) and if the button of the switch $SW_4$ is depressed for the purpose of changing the number of copies set to 4, bins of the sorter 2 move upward owing to both information when the copying operation is suspended and then stop at the specific standard position where the bottom bin $S_1$ is connected to the paper exit 11 as shown in FIG. 1(*a*). Therefore, if the copying operation is started thereafter, the situation shown in FIG. 3 is created and correct paper collating operation is thus ensured.

With the method of the present invention, as stated above, the interruption of the copying operation caused by the returning of bins is made only when the number of copies set is changed and also it is made when the copying operation is suspended and therefore, it is possible to prevent the occurrence of jamming caused by the timing of paper delivery and the timing of bin movement which are not synchronized and thus the operability and reliability are improved in addition to the merit of aforesaid sorting in both directions. Incidentally, the electric circuit shown in FIG. 2 can naturally be realized by the microcomputer.

What is claimed is:

1. In a copying machine with a reciprocal sorter having movable bins capable of collating in upward and downward directions through a number of bins corresponding to a selected number of copies set for copying originals, the improvement comprising a detecting means for generating a signal in response to a change of the number of copies during the collating operation and an automatic means for returning the movable bins to a specific standard position in response to the signal.

2. The copying machine of claim 1, wherein said specific standard position is a position in which an uppermost bin can receive a recorded paper from an exit of a copying machine.

3. The copying machine of claim 1, wherein said specific standard position is a position in which a recorded paper from an exit of a copying machine is received in a non-sorting mode.

4. The copying machine of claim 1, wherein said movable bins are arranged to return to said standard position upon completion of sorting of a last original.

* * * * *